US011457735B1

(12) United States Patent
D'Isep

(10) Patent No.: US 11,457,735 B1
(45) Date of Patent: Oct. 4, 2022

(54) STORAGE SYSTEM

(71) Applicant: Lucio D'Isep, Cypress, TX (US)

(72) Inventor: Lucio D'Isep, Cypress, TX (US)

( * ) Notice: Subject to any disclaimer, the term of this patent is extended or adjusted under 35 U.S.C. 154(b) by 0 days.

(21) Appl. No.: 17/393,739

(22) Filed: Aug. 4, 2021

(51) Int. Cl.

| | |
|---|---|
| ***A47B 57/00*** | (2006.01) |
| ***A47B 96/00*** | (2006.01) |
| ***A47F 5/08*** | (2006.01) |
| ***A47B 45/00*** | (2006.01) |
| ***A47B 57/04*** | (2006.01) |
| ***A47B 96/14*** | (2006.01) |
| *A47F 7/04* | (2006.01) |

(52) U.S. Cl.
CPC ..... *A47B 45/00* (2013.01); *A47B 57/04* (2013.01); *A47B 57/045* (2013.01); *A47B 96/1425* (2013.01); *A47F 5/0853* (2013.01); *A47F 7/04* (2013.01)

(58) Field of Classification Search
CPC ..... A47B 57/265; A47B 96/1425; A47B 5/04; A47B 45/00; A47F 5/08; A47F 7/04; A47F 5/0853
USPC ..... 211/103, 90.01; 248/200.1, 240.2, 240.4, 248/250, 354.3, 222.14, 219.2, 188.5
See application file for complete search history.

(56) References Cited

U.S. PATENT DOCUMENTS 919,526 A * 4/1909 Belcher ..... A47B 57/42 211/90.01
1,730,618 A * 10/1929 Mayo ..... E04G 11/486 254/104
3,184,068 A * 5/1965 Wende ..... A47F 7/04 211/23
3,485,382 A * 12/1969 Larson ..... A47F 5/0815 248/220.42
3,710,734 A * 1/1973 Bofferding ..... A47B 57/56 248/246
3,968,883 A * 7/1976 Farmer ..... H02B 1/01 361/825
3,981,116 A * 9/1976 Reed ..... E04B 9/183 52/506.1
4,145,849 A * 3/1979 Shindoll ..... A47B 96/00 108/187
4,221,086 A * 9/1980 Berman ..... G07F 19/201 52/65
4,813,550 A * 3/1989 Saeks ..... A47B 96/1408 211/17
5,083,729 A * 1/1992 Saeks ..... B62H 3/12 211/17
5,381,738 A * 1/1995 Meyer ..... A47B 5/00 108/42
5,617,698 A * 4/1997 Guilmette ..... B25B 5/06 248/205.6

(Continued)

*Primary Examiner* — Kimberley S Wright
(74) *Attorney, Agent, or Firm* — Jeffrey L. Streets; Streets Lawfirm

(57) ABSTRACT

A storage system may be formed using an apparatus including a rigid bar and a bracket. The rigid bar has an elongate body having sufficient length to extend vertically along a wall from a foot engaging the floor to a second end positioned proximate to a ceiling directly above the floor. The bracket is securable to the ceiling and has a first end for engaging the rigid bar at a point proximate to the second end of the rigid bar, wherein the first end of the bracket limits movement of the second end of the rigid bar in a direction away from the wall. Optionally, a pair of the rigid bars may include shelf supports, tire lofts or other features for supporting items to be storage.

5 Claims, 10 Drawing Sheets

(56) References Cited

U.S. PATENT DOCUMENTS

| | | | | |
|---|---|---|---|---|
| 5,775,655 | A * | 7/1998 | Schmeets | A47B 5/00 108/115 |
| 5,803,273 | A * | 9/1998 | Menaged | A47F 5/0807 211/105.1 |
| 5,979,854 | A * | 11/1999 | Lundgren | E04F 21/1822 248/354.3 |
| 6,068,225 | A * | 5/2000 | O'Brien | A61G 7/053 248/200.1 |
| 6,293,056 | B1 * | 9/2001 | He | F16L 3/26 248/49 |
| 6,820,842 | B1 | 11/2004 | Chuang | |
| 8,528,748 | B2 | 9/2013 | Shaha et al. | |
| 8,763,821 | B2 | 7/2014 | Yang et al. | |
| 9,107,496 | B2 | 8/2015 | Lindo et al. | |
| 10,470,565 | B1 * | 11/2019 | Levi | A47F 5/103 |
| 2001/0029715 | A1 * | 10/2001 | Bradley | E04F 21/18 52/344 |
| 2005/0139742 | A1 * | 6/2005 | Frisell | F16M 11/043 248/317 |
| 2005/0188903 | A1 * | 9/2005 | Ryberg | A47B 96/024 108/149 |
| 2008/0250731 | A1 * | 10/2008 | Wheeler | E04G 23/0237 52/167.1 |
| 2015/0157124 | A1 | 6/2015 | Cipolla | |
| 2015/0201750 | A1 * | 7/2015 | Hopkins | A47B 43/003 211/75 |

* cited by examiner

STORAGE SYSTEM

BACKGROUND

The present disclosure relates to a storage system, such as a system for supporting shelves along a wall.

BACKGROUND OF THE RELATED ART

Many types of storage systems, units and devices have been developed for storing a wide variety of items. A few of the most common types of storage include shelves, cabinets, and hanging racks. However, even simple shelves may be implemented in various forms. For example, narrow-depth shelves may be provided as a pre-assembled free-standing set of shelves, such as a wooden bookcase. Other shelves may be provided as a free-standing metal shelving rack that includes a set of deep shelves after some user assembly. Shelves may also be provided as individual wall-attached shelves, such as those using shelf brackets secured by large screws driven into studs within the walls. Still other shelves may utilize a track system that is permanently secured to the wall, such that individual shelves, shelf brackets or hooks may be easily positioned and repositioned in various locations along the track. Yet another type of storage is an overhead rack.

Each of these types of storage have their benefits and their drawbacks. Stand-alone shelves may require fewer tools or skills to assembly and are easy to move from one place to another but may consume precious floor space and/or have constrained shelf space that is inadequate for some large items. Wall-mounted shelves may not consume any floor space but may require more planning before drilling into a wall, may require greater use of tools, and may not be able to support heavy items. Track systems are also mounted to the walls and have similar limitations as other wall-mounted shelves but may provide more flexibility in the configuration of the shelves as needs change over time. Furthermore, any wall-mounted shelves may become a fixture that must remain with the property when the tenant moves. Even if the wall-mounted shelves are removed, there will be numerous holes to repair and the entire wall may need to be repainted. Overhead racks have similar limitations and benefits as wall-mounted shelves, but the weight is hung from the ceiling rather than being supported from the walls. These existing types of shelves are often inadequate for the storage of large or heavy items. As a result, large and heavy items are often set or stacked directly on the floor to avoid having to build a custom storage system.

BRIEF SUMMARY

Some embodiments provide an apparatus comprising a rigid bar and a bracket. The rigid bar has a first end forming a foot for engaging a floor, a second end opposite the first end, and an elongate body having sufficient length to extend vertically along a wall with the foot engaging the floor and with the second end positioned proximate to a ceiling directly above the floor. The bracket is securable to the ceiling and has a first end for engaging the rigid bar at a point proximate to the second end of the rigid bar, wherein the first end of the bracket limits movement of the second end of the rigid bar in a direction away from the wall.

Some embodiments provide an apparatus include a first rigid bar, a first rigid bracket and a first shelf support. The first rigid bar has a lower end forming a first foot for engaging a floor, an upper end opposite the lower end, and an elongate body having sufficient length to extend vertically along a wall with the first foot engaging the floor and the upper end positioned proximate to a ceiling directly above the floor. The first bracket is securable to the ceiling and has a first end hinged to the first rigid bar at a point proximate to the upper end of the first rigid bar, wherein the first end of the first bracket limits movement of the upper end of the first rigid bar in a direction away from the wall. The first shelf support is pivotally secured to the first rigid bar for moving the first shelf support between a retracted position and an extended position in a direction away from the wall, wherein the first shelf support is securable in the extended position. Optionally, the apparatus may further include a second rigid bar, a second bracket, and a second shelf support. The second rigid bar has a lower end forming a second foot for engaging the floor, an upper end opposite the lower end, and an elongate body having sufficient length to extend vertically along the wall with second the foot engaging the floor and the upper end positioned proximate to the ceiling directly above the floor. The second bracket is securable to the ceiling and has a first end hinged to the second rigid bar at a point proximate to the upper end of the second rigid bar, wherein the first end of the first bracket limits movement of the upper end of the second rigid bar in a direction away from the wall. The second shelf support is pivotally secured to the second rigid bar for moving the second shelf support between a retracted position and an extended position in a direction away from the wall, wherein the second shelf support is securable in the extended position. Securing the first and second shelf supports in the extended position enables a shelf to be supported by the first and second shelf supports.

DETAILED DESCRIPTION

Figure 1A:
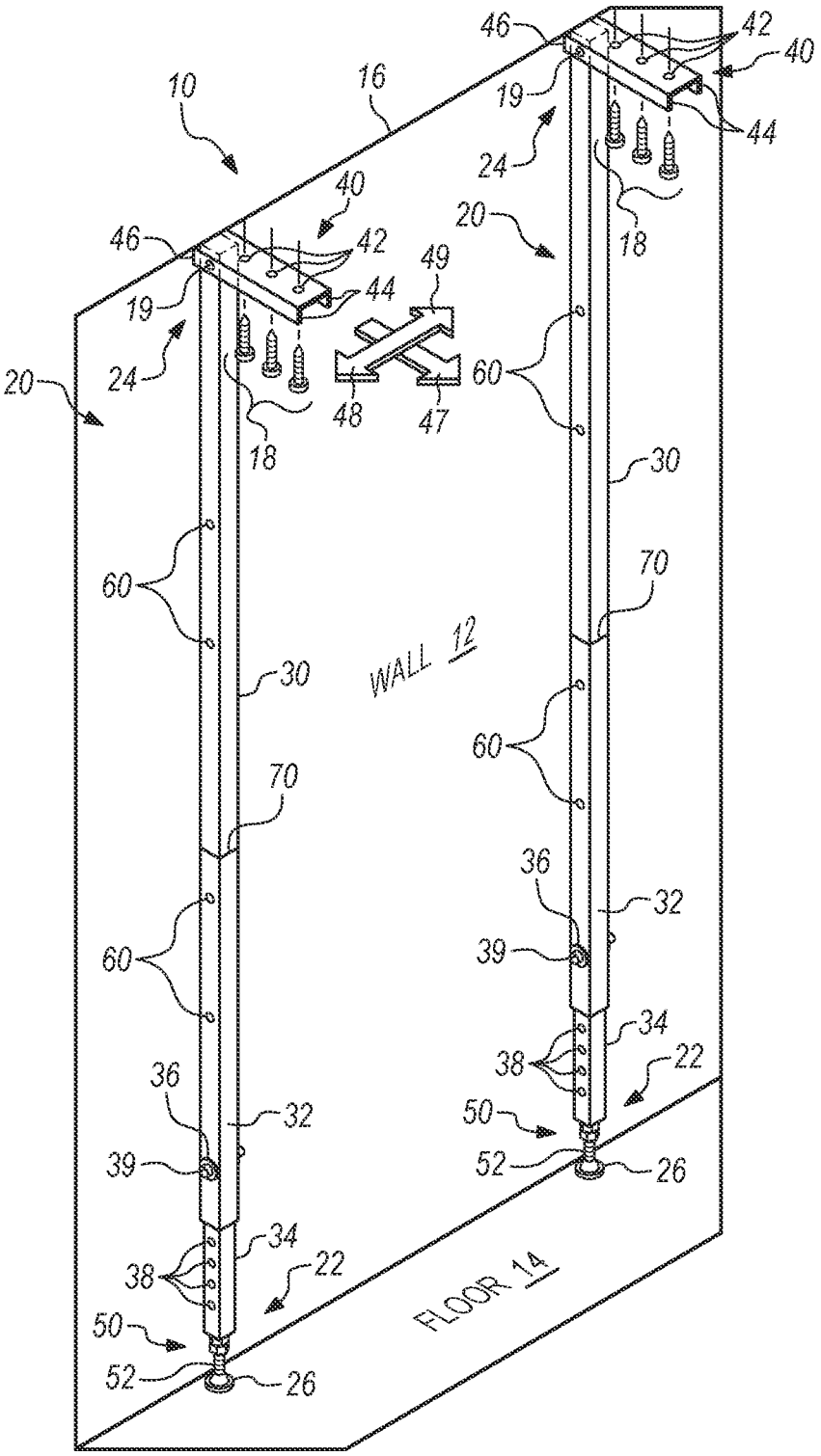
FIGS. 1A-B are perspective and side views of a first storage system in positioned against a wall and extending from a floor to a ceiling.

Some embodiments provide an apparatus comprising a rigid bar and a bracket. The rigid bar has a first end forming a foot for engaging a floor, a second end opposite the first end, and an elongate body having sufficient length to extend vertically along a wall with the foot engaging the floor and with the second end positioned proximate to a ceiling directly above the floor. The bracket is securable to the ceiling and has a first end for engaging the rigid bar at a point proximate to the second end of the rigid bar, wherein the first end of the bracket limits movement of the second end of the rigid bar in a direction away from the wall.

The rigid bar may take many forms. For example, the rigid bar may be selected from a solid bar, a tubular bar, a channel bar, or other shapes or structures. Furthermore, the rigid bars may have various cross-sectional shapes, such as round, oval, rectangular, triangular, or more complex shapes. The rigid bar may have a wide range of rigidity but should not bend or bow under the load of items being supported by the rigid bar. The dimensions and thickness of the rigid bar or its tubular walls may also vary according to a desired range of weight capacity. Non-limiting examples of suitable materials for a rigid bar includes carbon steel, stainless steel, titanium, aluminum alloys, carbon fiber composites, and other high performance fiber composites. One specific example of the rigid bar is a straight section of a tubular bar having square cross-sectional dimensions of about 1.5 inches by about 1.5 inches and made with steel. The term "bar", as used herein, means that the piece of a material is longer than it is wide. Typically, the bar will be many times longer than it is wide. For example, the rigid bar may extend vertically from about 7 to about 11 feet while having a width from about 1 to about 2 inches. So, the rigid bar could be described as having an aspect ratio (height:width) from about 40 to about 120.

Some embodiments of the rigid bar may be telescopically adjustable in length and securable in a plurality of incremental lengths. For example, the rigid bar may include multiple bar sections, including a first tubular bar section having a hollow internal cavity that slidably receives a second tubular bar section. Accordingly, the extent to which the second tubular bar section extends from the first tubular bar section may be selected and secured using a fastener and a set of preformed or predrilled holes. For example, a hole may be formed through two opposing sides of the first tubular bar section, and a series of holes may be formed through two opposing sides of the second tubular bar. Preferably, the series of holes are formed at incremental distances along the length of the second tubular bar. The second tubular bar may be slidably moved within the first tubular bar to achieve a total length of the rigid bar that is roughly desired, and the nearest hole in second tubular bar section may be aligned with the hole in the first tubular bar section. A fastener, such as a bolt with nut or a secureable pin, may then be inserted through the aligned holes of the first and second tubular bar sections.

Some embodiments of the apparatus may include a threadably adjustable member that is rotatable to adjust the length of the rigid bar, either alone as the only means of adjusting the length of the rigid bar or in combination with a telescopically adjustable rigid bar such that there are two means for adjusting the length of the rigid bar. For a rigid bar including the combination of length adjustment means, the threadably adjustable member may be used to adjust the rigid bar to any length between the incremental lengths set by the telescopically adjustable rigid bar sections. For example, the threadably adjustable member may be a threaded shaft connecting the foot to the second rigid bar section. In such an embodiment, the telescopic adjustment may be considered to be a "coarse" length adjustment and the threaded adjustment may be considered to be a "fine" length adjustment. The combined use of the telescopic and threaded adjustments may be configured to allow the rigid bar to be extended to any exact length (vertical height) over a broad range of lengths. For use in residential applications, the rigid bar could be extendible from about 8 feet to about 12 feet, from about 8 feet to about 10 feet, or over any desired range of lengths that would reach from floor to ceiling in a residential home or garage. Although embodiments may not be required to reach entirely from the floor to the ceiling, the rigid bar should extend high enough to position the second (upper) end of the rigid bar sufficiently close to the ceiling to be engaged by the bracket. Furthermore, the second (upper) end of the rigid bar should be positioned sufficiently close to the ceiling so that the rigid bar does not hang from the bracket during normal use. In other words, the weight of the rigid bar and any items supported by the rigid bar should be supported by the floor, not the ceiling. The specific ideal distance of the second (upper) end of the rigid bar from the ceiling is a function of the bracket type and dimensions being used.

Some embodiments of the apparatus may include a rigid bar that is cut-to-length for installation in a particular location. Specifically, in a particular room or facility, such as a garage, the distance between the floor and the ceiling may be measured. Accordingly, the rigid bar may be cut as a function of this measured distance, perhaps cut so that the second (upper) end is either just short of the ceiling or aligned for connection or engagement with a bracket that is secured or securable to the ceiling. Optionally, a cut-to-length rigid bar may omit the coarse telescopic adjustment and/or the fine rotational adjustment. Still, the cut-to-length rigid bar may include a foot, pad or end cap that grips the floor better than a bare end of the rigid bar.

In some embodiments, the bracket may include one or more openings for receiving a fastener that secures the flat portion of the bracket to the ceiling. For example, the openings may be holes or slots in the bracket, and a suitable fastener is a wood screw or lag bolt. The fastener preferably secures the bracket to a stud or beam in the ceiling. Optionally, the bracket may include a flat portion the includes the one or more openings. Although a sturdy and fixed connection between the bracket and the ceiling (i.e., a stud or beam) is desired, it should be appreciated that the bracket does not suspend or hang the rigid bar when the rigid bar is in it's vertical, weight-bearing, operable position. The bracket is not responsible for supporting any significant downward forces during normal use of the rigid bar to support various items. Rather, the bracket is responsible for keeping the second (upper) end in a fixed position vertically above the foot and the bracket must be held firming in place to oppose lateral forces of the second (upper) end directed away from the wall (i.e., into the room). The bracket may also be responsible for opposing any lateral forces of the second (upper) end directed along the wall (i.e., left or right from the perspective of a user in the center of the room facing the wall). However, the wall itself may oppose any lateral forces directed toward the wall.

In some embodiments, the bracket may be a channel selected from a U-shaped channel and an L-shaped channel. The bracket may be made from a metal or any other material that is suitable for the rigid bar. The bracket and the rigid bar are preferably made with the same material, but they may be made from separate materials. Furthermore, the bracket may be secured or securable to the second end of the rigid bar. In one example, the first end of the bracket is hinged to the rigid bar proximate the second end of the rigid bar, such that the rigid bar is positionable against the wall and the bracket is positionable for securing to the ceiling. In one option, the hinge may enable the bracket to pivot toward and receive a portion of the rigid bar within the bracket, such as for compact packaging, storage or shipment. In another option, the hinge connection may include a slot, either in the second (upper) end of the rigid bar or in the bracket, to provide a range of vertical positions for the second (upper) end of the rigid bar over which the bracket may provide the lateral support of the second (upper) end of the rigid bar without providing any significant support of the weight of the rigid bar and items supported by the rigid bar. Accordingly, the length adjustment of the rigid bar may be simplified or the positioning of the second (upper) end of the rigid bar may be given a greater tolerance using a hinge with a slot, such as a vertical slot.

In some embodiments, the bracket may include a first opening and the second end of the rigid bar may include a second opening, wherein the first and second openings are alignable for receiving a fastener that secures the second end of the rigid bar to the bracket. The first and second openings may be holes and/or slots. For example, the bracket may include a vertical plate with the first opening and the rigid bar may include a vertical plate with the second opening. With the vertical plates in face-to-face contact, the first and second opening may be aligned and a fastener may be secured through the aligned openings to secure the vertical plates together. Accordingly, the second (upper) end of the rigid bar is prevented from movement lateral away from the wall and along the wall because the bracket is secured to the ceiling and the second end of the rigid bar is secured to the bracket via the fastened vertical plates.

In some embodiments, the first end of the bracket may form a slot or socket that receives the second end of the rigid bar to limit and/or prevent the second end of the rigid bar from moving away from the wall or along the wall. A preferred slot or socket may slidably receive the second (upper) end of the rigid bar without any connection there between. However, the slot or socket may extend around three sides of the second (upper) end of the rigid bar to prevent movement in three directions—away from the wall, leftward along the wall, and rightward along the wall. Alternatively, the slot or socket may extend around four sides of the second (upper) end of the rigid bar.

Some embodiments of the rigid bar may include two rigid bar sections that are selectively axially securable to form the rigid bar. The rigid bar sections may be used to extend the length of the rigid bar for use in rooms or facilities having different ceiling heights. Furthermore, the rigid bar sections may be used to facilitate compact packaging, storage or shipment. For example, an 8-foot long rigid bar may include two rigid bar sections that are each about 4-feet to about 5 feet long. The rigid bar sections may be connected together with a separate tubing connector having opposing connector ends that extend into the hollow ends of two rigid bar sections. Optionally, the separate tubing connector may include a radial flange that sits between the rigid bar sections to keep the tubing connector in place relative to the interface between the rigid bar sections. Alternatively, a first rigid bar may include a first end received within a hollow end of a first rigid bar section formed with tubing, and the first rigid bar may be secured in this position with a bolt or welded connection. A second end of the first rigid bar may extend from the first rigid bar section to be selectively received in a hollow end of a second rigid bar section and secured in this position with a bolt. The first rigid bar and the first and/or second rigid bar sections may have one or more alignable holes to enable bolting or otherwise fastening the first rigid bar to the first and/or second rigid bar sections prior to use. In one example, the first rigid bar may extend about 6 inches to about 12 inches into the first and/or second rigid bar sections.

Some embodiments of the apparatus further include one or more shelf supports secured or securable to the rigid bar, wherein the one or more shelf supports extend from the rigid bar in a direction away from the wall. In one option, the one or more shelf supports are secured to the rigid bar with a hinge or pivot for moving the one or more shelf supports between a retracted position and an extended position. Each shelf support may include a shelf support arm and an angle brace for supporting the horizontal shelf support arm in an extended position. The shelf support arm and the angle brace may be independently hinged to the rigid bar, but including a connector for securing the shelf support arm and the angle brace together. For example, the shelf support arm and the angle brace may each be pivoted to a retracted position for packaging, storage, shipment or during periods of non-use. However, the shelf support arm and the angle brace may each be pivoted forward (away from the wall) and secured together in the extended position. Together with the rigid bar, the shelf support arm and angle brace may form a rigid triangular structure that can support significant weight. The shelf support arm and angle brace may be independently selected from channels and tubular bars. A preferred rigid bar may have two shelf supports secured thereto, such that a pair of spaced-apart rigid bars with two shelf supports at the same heights may support shelf boards or other structures to form a pair of shelves or a pair of rack structures.

Some embodiments of the apparatus may be characterized in that the bracket keeps the rigid bar in a vertical orientation without any attachment between the rigid bar and the wall. Although the bracket is secured to the ceiling, the attachment to the ceiling does not bear the full weight of the rigid bar and items supported from the rigid. Accordingly, the number and size of the screws or other fasteners used to install the apparatus is reduced. This both reduces the effort and planning necessary to install the apparatus relative to other shelving systems, but also reduces the effort and repair necessary to remove the apparatus relative to other shelving systems. Still further, if the rigid bar is not supporting other items, some embodiments allow the rigid bar to be lifted or shortened slightly so that the first (lower) end of the rigid bar may be swung outward away from the wall without disconnecting the bracket. This capability enables the walls to be painted without uninstalling the apparatus.

Some embodiments of the apparatus may be characterized in that the foot is directed to rest on the floor and support substantially all of the weight of the rigid bar and any item supported on the rigid bar. The strength of the rigid bar resists bowing and may obtain additional lateral support from the wall to prevent bowing. Furthermore, the rigid bar is strong in compression and can support substantial loads that are not supportable by typical wall-mounted shelves. The function of the bracket is not to support any of the weight of the rigid bar or items supported by the rigid bar, but rather to keep the rigid bar in an upright or vertical orientation. If the rigid bar supports shelves extending into the room away from the wall, any load placed on the shelves will impart a rotational force or torque about the point of contact between the foot and the floor. This rotational force is directed to tip the second (upper) end of the rigid bar away from wall. However, the bracket is positioned to retain the second (upper end) in the vertical position and is secured to the ceiling to oppose the rotational force. Note that if the rigid bar were attached to the wall with screws, the rotational force would tend to pull the screws out of the wall. However, the bracket may be screwed into the ceiling, such that the rotational force that is directed generally laterally away from the wall is direct generally across the ceiling. Screws directed upward into the ceiling studs or beams have a generally vertical axis and are stronger against shear forces (normal to the axis) than against tension forces (parallel with the axis).

Some embodiments of the apparatus provide the benefit of providing storage of large and/or heavy items. The weight of the storage system and the stored items is supported by the floor and does not hang from a wall or ceiling. The only limit on the weight capacity of the storage system is the strength of the rigid bar and shelf supports. Installation may be quick and simple, and may require only a small number of screws secured into a ceiling stud or beam. Furthermore, the apparatus does not consume any significant amount of floor space. Specifically, the only floor space consumed by the apparatus is the area of the foot of the rigid bar, which may be as little as about 1-3 square inches per rigid bar.

Some embodiments provide an apparatus include a first rigid bar, a first rigid bracket and a first shelf support. The first rigid bar has a lower end forming a first foot for engaging a floor, an upper end opposite the lower end, and an elongate body having sufficient length to extend vertically along a wall with the first foot engaging the floor and the upper end positioned proximate to a ceiling directly above the floor. The first bracket is securable to the ceiling and has a first end hinged to the first rigid bar at a point proximate to the upper end of the first rigid bar, wherein the first end of the first bracket limits movement of the upper end of the first rigid bar in a direction away from the wall. The first shelf support is pivotally secured to the first rigid bar for moving the first shelf support between a retracted position and an extended position in a direction away from the wall, wherein the first shelf support is securable in the extended position. Optionally, the apparatus may further include a second rigid bar, a second bracket, and a second shelf support. The second rigid bar has a lower end forming a second foot for engaging the floor, an upper end opposite the lower end, and an elongate body having sufficient length to extend vertically along the wall with the second foot engaging the floor and the upper end positioned proximate to the ceiling directly above the floor. The second bracket is securable to the ceiling and has a first end hinged to the second rigid bar at a point proximate to the upper end of the second rigid bar, wherein the first end of the first bracket limits movement of the upper end of the second rigid bar in a direction away from the wall. The second shelf support is pivotally secured to the second rigid bar for moving the second shelf support between a retracted position and an extended position in a direction away from the wall, wherein the second shelf support is securable in the extended position. Securing the first and second shelf supports in the extended position enables a shelf to be supported by the first and second shelf supports. Optionally, the first and second rigid bars may each include one or more additional shelf supports that may support one or more additional shelves. Furthermore, the foregoing apparatus embodiment may include any one or more component, feature or configuration described herein in the context of other apparatus embodiments.

Some embodiments may provide a kit of components that may be used to assembly and/or install the apparatus. For example, the kit may include one or more rigid bar, one or more bracket, and one or more shelf support. Furthermore, the kit may include any necessary fasteners, tools, templates and/or instructions. In one option, the kit may include a set of fasteners for securing the bracket to the ceiling adjacent to the wall.

Some embodiments provide a kit including a first rigid bar, a first rigid bracket and a first shelf support. The first rigid bar has a lower end forming a first foot for engaging a floor, an upper end opposite the lower end, and an elongate body having sufficient length to extend vertically along a wall with the first foot engaging the floor and the upper end positioned proximate to a ceiling directly above the floor. The first bracket is securable to the ceiling and has a first end hinged to the first rigid bar at a point proximate to the upper end of the first rigid bar, wherein the first end of the first bracket limits movement of the upper end of the first rigid bar in a direction away from the wall. The first shelf support is pivotally secured to the first rigid bar for moving the first shelf support between a retracted position and an extended position in a direction away from the wall, wherein the first shelf support is securable in the extended position. Optionally, the kit may further include a second rigid bar, a second bracket, and a second shelf support. The second rigid bar has a lower end forming a second foot for engaging the floor, an upper end opposite the lower end, and an elongate body having sufficient length to extend vertically along the wall with second the foot engaging the floor and the upper end positioned proximate to the ceiling directly above the floor. The second bracket is securable to the ceiling and has a first end hinged to the second rigid bar at a point proximate to the upper end of the second rigid bar, wherein the first end of the first bracket limits movement of the upper end of the second rigid bar in a direction away from the wall. The second shelf support is pivotally secured to the second rigid bar for moving the second shelf support between a retracted position and an extended position in a direction away from the wall, wherein the second shelf support is securable in the extended position. Securing the first and second shelf supports in the extended position enables a shelf to be supported by the first and second shelf supports. Optionally, the first and second rigid bars may each include one or more additional shelf supports that may support one or more additional shelves. Furthermore, the foregoing kit embodiment may include any one or more component, feature or configuration of the apparatus embodiments described herein. Any of the kits may be fully or partially assembled or fully or partially disassembled.

Some embodiments provide a method that includes positioning a first rigid bar in a vertical orientation against a wall, supporting the first rigid bar on a floor adjacent the wall, extending an upper end of the first rigid bar near a ceiling adjacent the wall, positioning a first bracket to engage the upper end of the first rigid bar, and securing the first bracket to the ceiling in a position to engage the upper end of the first rigid bar and limit any movement of the upper end of the first rigid bar in a direction away from the wall. Optionally, the method may further include positioning a second rigid bar in a vertical orientation against the wall, supporting the second rigid bar on the floor adjacent the wall and a spaced distance from the first rigid bar, extending an upper end of the second rigid bar near the ceiling adjacent the wall, positioning a second bracket to engage the upper end of the second rigid bar, and securing the second bracket to the ceiling in a position to engage the upper end of the second rigid bar and limit any movement of the upper end of the second rigid bar in a direction away from the wall. In another option, the method may still further include securing one or more shelf support to both the first rigid bar and the second rigid bar, wherein the one or more shelf support extends in a direction away from the wall. A shelf may then be positioned across a shelf support secured the first rigid bar and a shelf support secured to the second rigid bar.

In some embodiments of the method, the first rigid bar may be telescopically adjustable in length and securable in a plurality of incremental lengths. Furthermore, the operation of extending an upper end of the second rigid bar near the ceiling adjacent the wall may include telescopically adjusting the length of the first rigid bar to a greatest of the incremental lengths that still positions the upper end of the first rigid bar short of the ceiling with the first rigid bar in a vertical orientation with the foot contacting the floor, securing the first rigid bar in the greatest of the incremental lengths, and rotating a threadably adjustable member to increase the length of the first rigid bar until the upper end of the first rigid bar is sufficiently proximate the ceiling for the secured first bracket to engage the upper end of the second rigid bar and limit any movement of the upper end of the second rigid bar in a direction away from the wall.

Embodiments of the method may include any feature or aspect of the apparatus embodiments or kit embodiments, or any disclosed use of those apparatus or kit embodiments.

Figure 1B:
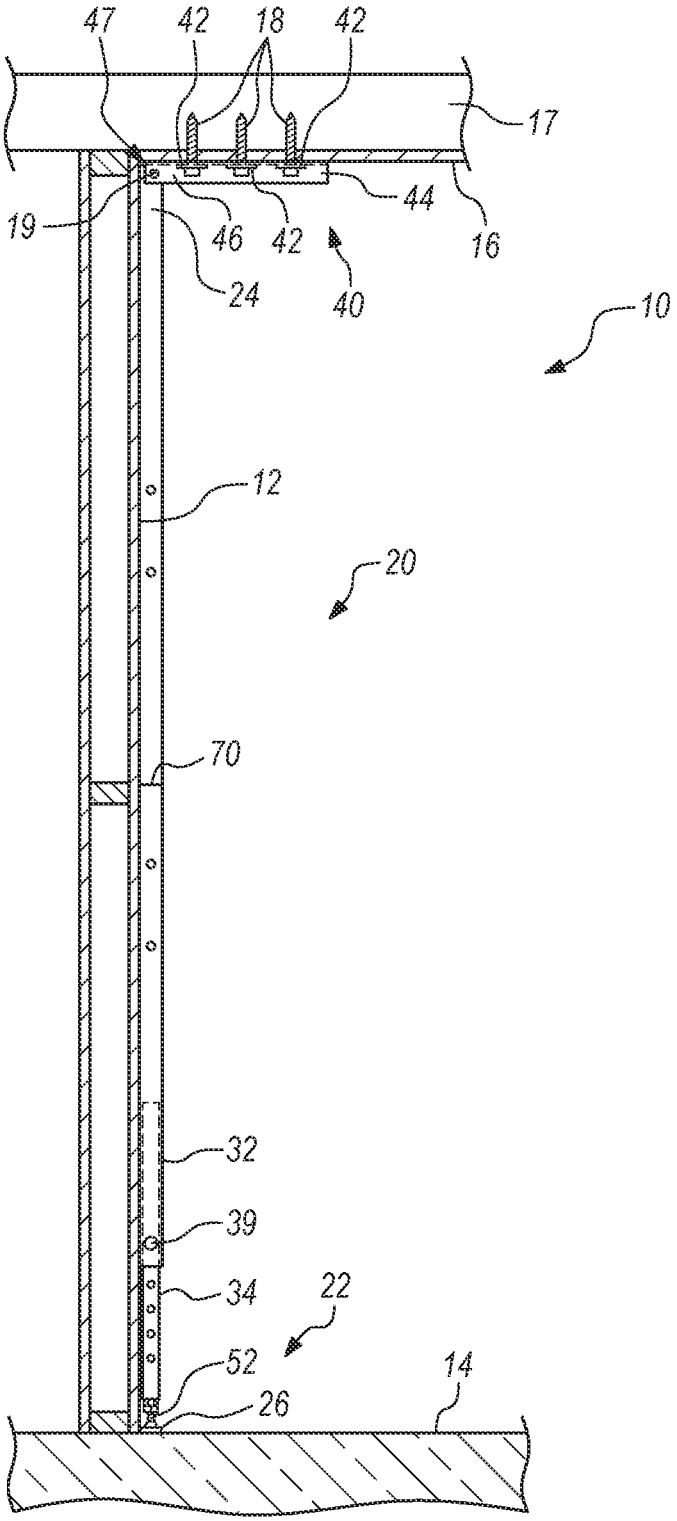

FIGS. 1A-B are perspective and side views of a first storage system 10 including two rigid bars 20 positioned against a wall 12 and extending from a floor 14 to a ceiling 16 (see also FIG. 1B). The storage system 10 further includes a bracket 40 for each of the rigid bars 20. While some storage systems may include a single rigid bar and bracket, storage systems with at least two rigid bars and brackets may be most common. The storage system 10 may further include shelf supports and/or other storage features. However, FIGS. 1A-B are shown to focus on the structure of certain embodiments of the rigid bars 20 and brackets 30.

In reference to FIG. 1A, each rigid bar 20 has a first (lower) end 22 for engaging the floor 14 and a second (upper) end 24 that is opposite the first end 22 and extends vertically upward to a position proximate to the ceiling 16. Each rigid bar 20 has an elongate body 30 having sufficient length to extend vertically along the wall 12 form the floor 14 to a position proximate to a ceiling 16 vertically above the floor 14. The first end 22 of each rigid bar 20 forms a foot 26 that engages the floor 14 such that the weight of the rigid bar 20 and any items supported from the rigid bar are supported by the floor 14.

The rigid bar 20 is also telescopically adjustable in length and securable in a plurality of incremental lengths. A first tubular bar section 32 has a hollow internal cavity or channel that slidably receives a second tubular bar section 34. A hole 36 may be formed through two opposing sides of the first tubular bar section 32, and a series of holes 38 may be formed through two opposing sides of the second tubular bar 34. The series of holes 38 are formed at incremental distances along the length of the second tubular bar section 34. The second tubular bar section 34 may be slidably moved within the first tubular bar section 32 to achieve a total length of the rigid bar 20 that is roughly desired. With one of the holes 38 in second tubular bar section 34 aligned with the hole 36 in the first tubular bar section 32, a fastener 39, such as a bolt with nut or a securable pin, may then be inserted through the aligned holes 36, 38 of the first and second tubular bar sections 32, 34. Accordingly, the extent to which the second tubular bar section 34 extends from the first tubular bar section 32 may be selected and secured using the fastener 39.

The rigid bar 20 further includes a threadably adjustable connection 50 that is rotatable to adjust the length of the rigid bar 20. In the embodiment shown, the threadably adjustable connection 50 may be used to adjust the rigid bar 20 to any length between the incremental lengths set by the telescopically adjustable rigid bar sections 32, 34. For example, the threadably adjustable connection may include a threaded shaft 52 connecting the foot 26 to the second rigid bar section 34. In such an embodiment, the telescopic adjustment between the two rigid bar sections 32, 34 may provide a "coarse" length adjustment and the threadably adjustable connection 50 may provide a "fine" length adjustment. The combined use of the telescopic and threaded adjustments may be configured to allow the rigid bar 20 to be extended to any exact length (vertical height) over a broad range of lengths that would reach from the floor 14 to a point proximate the ceiling 16 in a residential home or garage. Additional details of the telescopically adjustable tubular bar sections 32, 34 and the threadably adjustable connection 50 are provided in reference to FIGS. 7A-7B.

Each bracket 40 is securable to the ceiling 16 with threaded fasteners 18, such as wood screws or lag bolts. The brackets 40 include openings 42, such as three linearly arranged holes for receiving the threaded fasteners 18 therethrough, so that the bracket 40 is firmly secured to the ceiling. Each bracket 40 is shown as a C-channel having two parallel side flanges 44 that provide the bracket with lateral strength. The C-channel bracket 40 also has a first end 46 that forms a hinge connection with the second (upper) end 24 of the rigid bar 20. The hinge connection is formed by a hinge pin or bolt 19 extended through, and secured in, a hole in a first of the flanges 44, through a hole or holes in the rigid bar 20 at a location proximate to the second (upper) end 24 of the rigid bar 20, and then through a hole in a second of the flanges 44. The hinge connection may be formed after the rigid bar 20 and the bracket 40 are in their installed position (as shown), but the hinge connection is preferably formed prior to standing the rigid bar 20 against the wall and securing the bracket 40 to the ceiling. With the bracket 40 secured to the ceiling, the hinge connection serves to limit movement of the second end 24 of the rigid bar 20 in a direction away from the wall 12 (see arrow 47), as well as to limit movement of the second end 24 of the rigid bar 20 in a direction along the wall 12 (see arrows 48 and 49). As a result, the rigid bar 20 is kept in a vertical orientation. Additional details of the bracket 40 are provided in reference to FIGS. 4A-4D and alternative embodiments of the bracket are shown in reference to FIGS. 5A-6B.

The rigid bar 20 further includes holes or connectors 60 that may be used to connect shelf supports or other storage members. The shelf supports, for example, may be used to support the load of various storage items and transfer the weight or load of those items to the rigid bar. One embodiment of shelf supports is shown further in reference to FIGS. 3A-3B.

Still further, the elongate body 30 of the rigid bar 20 may be separated into two or more sections at some midpoint 70. Separating the elongate body 30 into at least two separate pieces may be helpful for packaging, storage, and shipment. One embodiment of a connection between separate sections are shown further in reference to FIGS. 8A-8B.

FIG. 1B is a side view of the storage system 10 of FIG. 1A. The storage system 10 has been installed in a room of a building, such as a residential garage. The room includes the floor 14, the wall 12 and the ceiling 16. The exposed surfaces of the floor, wall and ceiling may include various materials, coatings or treatments. However, the floor 14 is shown as a simple concrete surface, the wall 12 is shown as wood or metal stud construction covered with sheetrock, and the ceiling 16 is similarly shown as being sheetrock secured to a stud or beam 17.

The rigid bar 20 rests on the floor 14 and extends along the wall 12 to a point that is high enough to position the second (upper) end 24 sufficiently close to the ceiling 16 to be engaged by the bracket 40. Furthermore, the second (upper) end 24 of the rigid bar 30 is positioned sufficiently close to the ceiling 16 so that the rigid bar 30 does not hang from the bracket 40 during normal use. In other words, the weight of the rigid bar 30 and any items supported by the rigid bar should be supported by the floor 14, not the ceiling 16 or beam 17.

The bracket 40 is secured to beam 17 with fasteners 18 that extend through the holes 42 and held firmly against the ceiling 16. The fasteners 18 are preferably screws or lag bolts that are threadably secured into the beam 17. Accordingly, the bracket 40 is secured in place and is able to oppose lateral forces in a direction away from the wall 12 (to the right as shown in FIG. 1B). The first end 46 of the bracket 40 engages the second (upper) end 24 of the rigid bar 30 to limit or prevent movement away from the wall 12. Specifically, the first end 46 of the C-channel bracket 40 forms a hinge connection with the second (upper) end 24. The hinge connection is formed by a hinge pin or bolt 19 that extends through a hole in a first of the flanges 44, through a hole or holes in the rigid bar 20 at a location proximate to the second (upper) end 24 of the rigid bar 20, and then through a hole in a second of the flanges 44.

Note that there is a small gap 47 between the second (upper) end 24 of the rigid bar 20 and the ceiling 16. This gap 47 is possible, but not required, so long as the second (upper) end 24 extends sufficiently close to the ceiling 16 to be engaged by the bracket 40 and prevent the rigid bar 20 from applying any significant downward-directed force (weight) on the bracket 40 and its fasteners 18. In other words, the bracket 40 should only be relied upon to oppose lateral forces away from the wall or along the wall and, therefore, to keep the second (upper) end 24 in a position vertically above the foot 26. It should be noted that the wall 12 may be relied upon to oppose lateral forces directed toward the wall 12. Furthermore, FIG. 1B highlights that the rigid bar 20 rests directly on the floor 12 adjacent the wall 12 and consumes very little floor space in the room.

Figure 2:
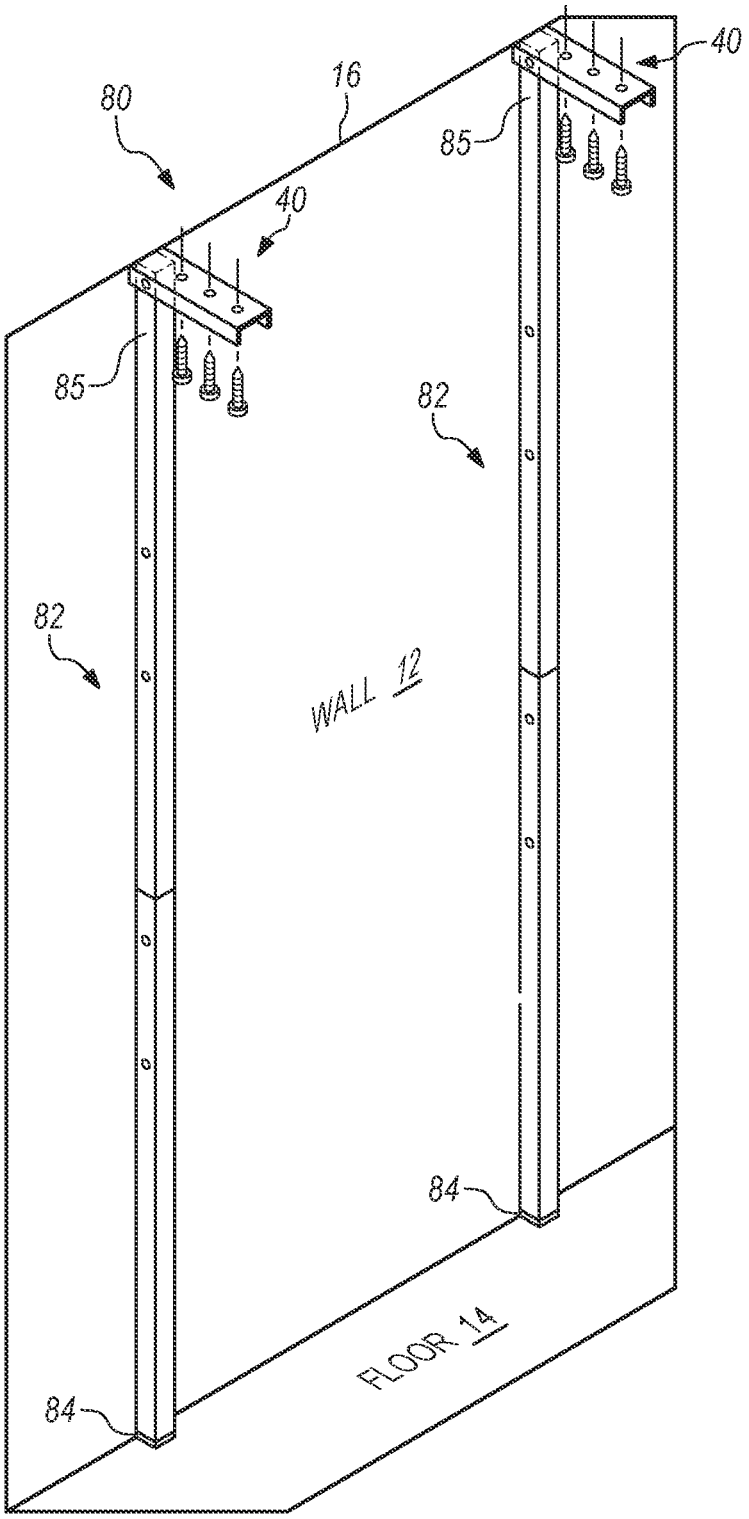
FIG. 2 is a perspective view of a second storage system in positioned against a wall and extending from a floor to a ceiling.

FIG. 2 is a perspective view of a second storage system 80 positioned against the wall 12 and extending from the floor 14 to the ceiling 16. The second storage system 80 includes a pair of rigid bars 82 that include feet 84 that rest on the floor 14. Each rigid bar 82 may include one or more section of rigid material, such as a square tubular channel. Given the possibility of variations in the height of the ceiling 16 above the floor 14 in the location adjacent the wall 12, one of the one or more sections of the rigid bar 82 may be cut-to-length so that the upper end 85 is positioned proximate to the ceiling 16 for engagement with the bracket 40. The rigid bars 82 may further include any one or more component or feature of the rigid bars 20 of the first storage system 10.

Figure 3A:
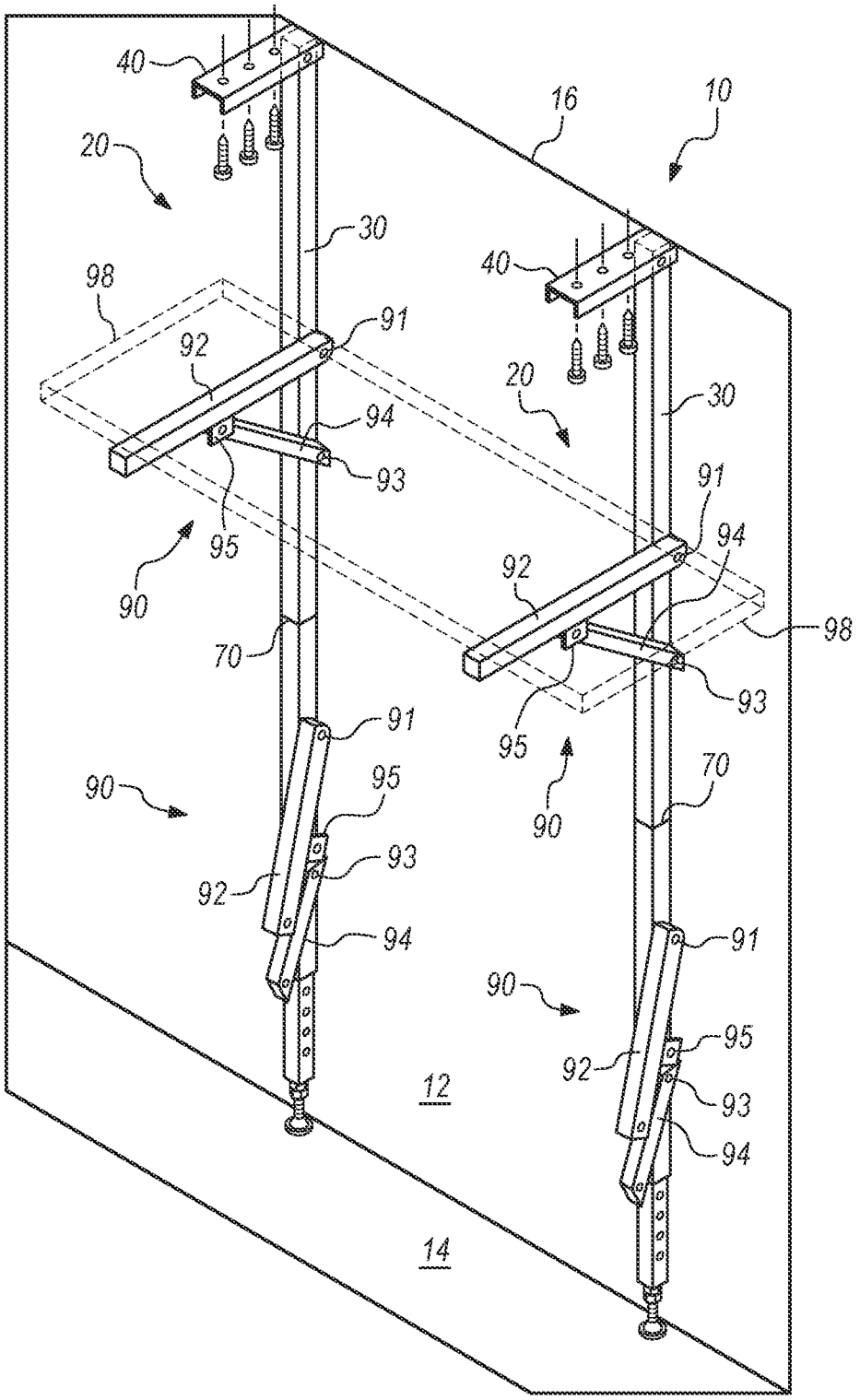
FIG. 3A is a perspective view of the first storage system with attached shelf brackets for supporting various items.

FIG. 3A is a perspective view of the first storage system 10 with attached shelf supports 90 for supporting various items from the rigid bars 20. A first (upper) shelf support 90 of each rigid bar 20 is shown in an extended and operative position extending in a direction away from the wall 12, whereas a second (lower) shelf support 90 of each rigid bar 20 is shown in a retracted and in operative position. The shelf supports 90 are secured to the rigid bars 20 with a hinge or pivot connection for quickly moving the one or more shelf supports 90 between the extended and retracted positions.

Each shelf support 90 includes a shelf support arm 92 and an angle brace 94 for supporting the horizontal shelf support arm 92 in an extended position. The shelf support arm 92 and the angle brace 94 may be independently hinged to the rigid bar 20, such as at pivot connection 91 and pivot connection 93, respectively. For example, the shelf support arm 92 and the angle brace 94 may each be pivoted to a retracted position for packaging, storage, shipment or during periods of non-use. However, the shelf support arm 92 and the angle brace 94 may each be pivoted forward (away from the wall 12) and secured together in the extended position. To secure the shelf support 90 in the extended position, a connector 95 is provided on the bottom of the shelf support arm 92 for receiving and securing the angle brace 94 together. The connector 95 of shelf support arm 92 and the angle brace 94 may have holes that can be aligned and secured together with a bolt and nut. For example, the connector 95 may have a pair of side plates that receive an end of the angle brace therebetween, and a bolt or other fastener is secured through holds in the side plates and angle brace. When connected with the rigid bar 20, the shelf support arm 92 and the angle brace 94 may form a rigid triangular structure that can support significant weight. The shelf support arm and angle brace may be independently selected from channels and tubular bars. A preferred rigid bar 20 may have two shelf supports 90 secured thereto, such that a pair of spaced-apart rigid bars 20 each with upper and lower shelf supports 90 at the same heights may support shelf boards 98 or other structures to form a pair of shelves or rack structures.

Figure 3B:
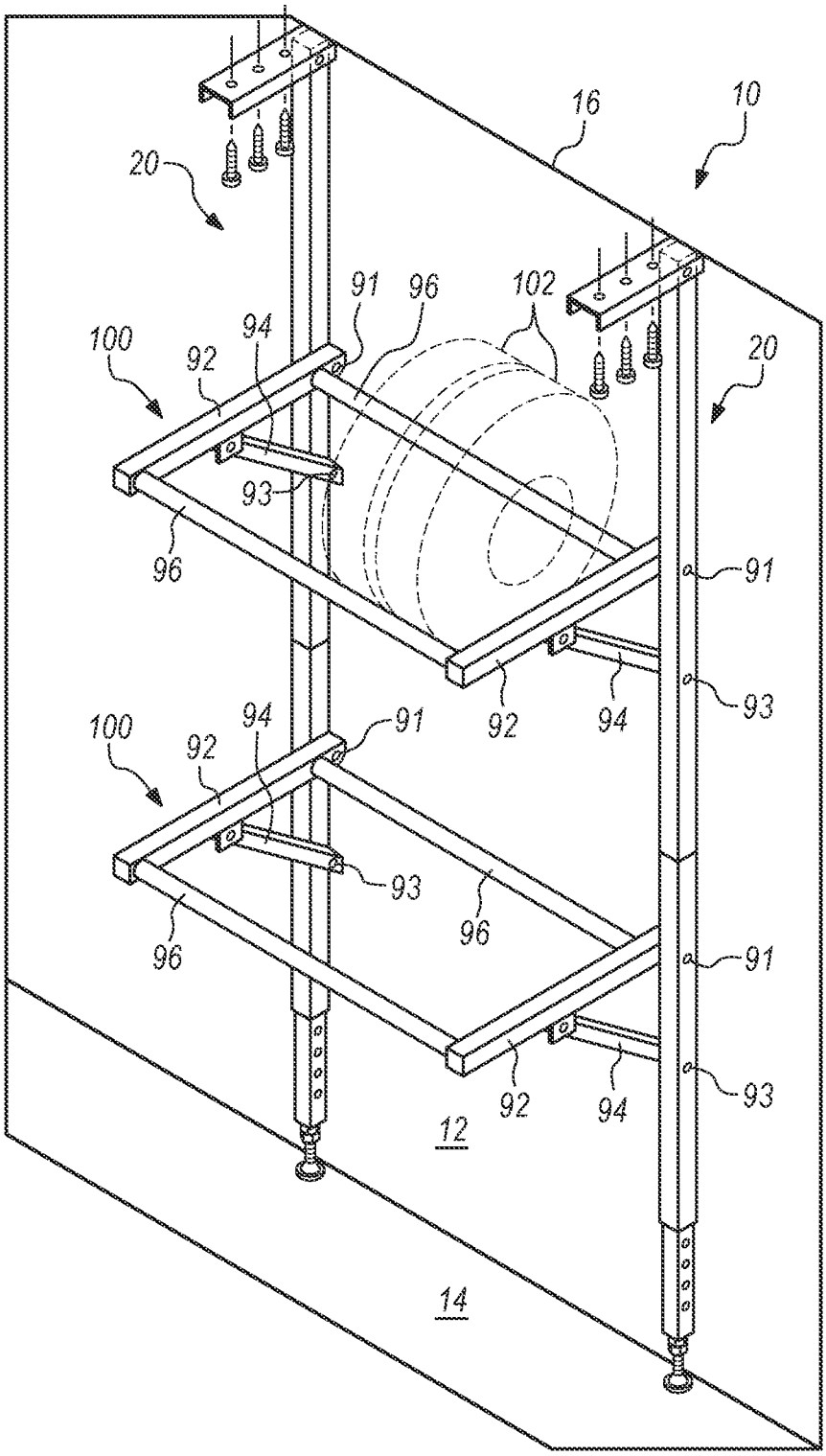
FIG. 3B is a perspective view of the first storage system with attached tire lofts for supporting a set of tires.

FIG. 3B is a perspective view of the first storage system 10 with attached tire lofts 100 for supporting one or more sets of tires 102 (only two shown). The tire lofts 100 may be utilize the same shelf support arm 92 and the angle brace 94 as described in reference to FIG. 3A, which may still be independently hinged to the rigid bar 20, such as at pivot connection 91 and pivot connection 93, respectively. However, the shelf support arms 92 and the angle braces 94 are secured to each of the rigid bars 20 so that they face each other. Specifically, as shown in FIG. 3B for the right-hand rigid bar 20, the shelf support arms 92 and the angle braces 94 secured to the right-hand rigid bar 20 are now secured on the left-hand side of the rigid bar 20. By contrast, the left-hand rigid bar 20 has the shelf support arms 92 and the angle braces 94 secured to the right-hand side of the rigid bar 20. Accordingly, the shelf support arms 92 and the angle braces 94 of the two rigid bars 20 directly face each other, such that a pair of rails 96 may extend between the left and right shelf support arms 92 to form the tire loft 100. Note that by positioning the shelf support arms 92 to face each other, the rails 96 may remain secured to the shelf-support arms 92 even if the shelf support arms 92 are pivoted to the retracted position.

Figure 4A:
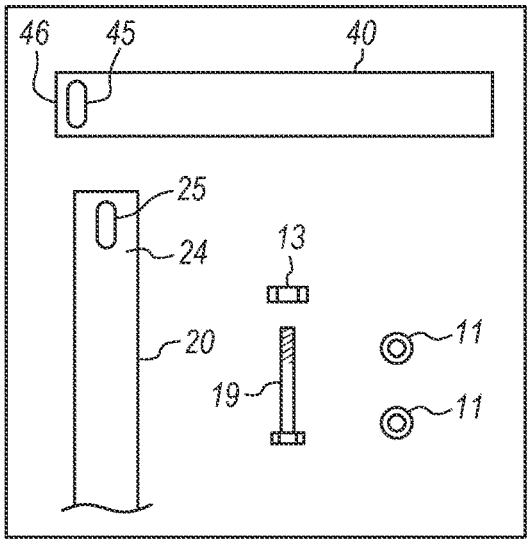
FIGS. 4A-D are various views of a first bracket and assembly for holding the storage system in an upright position.

FIGS. 4A-D are various views of a first bracket 40 and assembly for holding the storage system in an upright position. FIG. 4A illustrates the components involved in forming a hinge connection between the bracket 40 and the second (upper) end 24 of a rigid bar 20. The bracket 40 includes a hole 45 and the second (upper) end 24 of a rigid bar 20 includes a hole 25. A bolt 19 may serve as a hinge pin to hingedly couple the bracket 40 to the second (upper) end 24 of a rigid bar 20. A pair of washers 11 and a nut 13 are provided to assist with the operation and securing of the bolt 19.

Figure 4C:
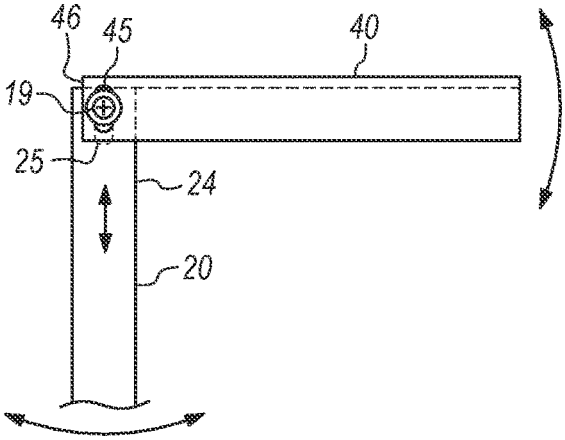
Figure 4B:
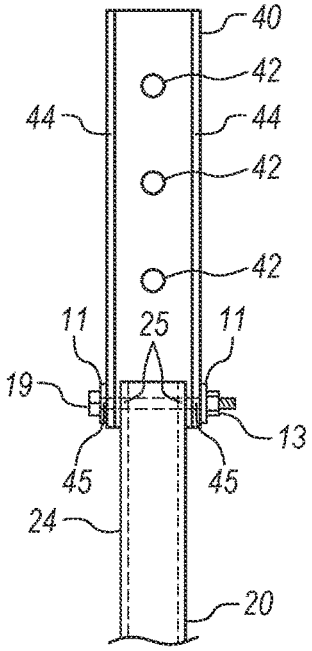

FIG. 4B illustrates the bracket 40 secured to the second (upper) end 24 of a rigid bar 20 by the bolt 19. Specifically, the shaft of the bolt 19 is extended through a first washer 11, a first hole 45 in a first of the flanges 44, through a hole or holes 25 in the rigid bar 20 at a location proximate to the second (upper) end 24 of the rigid bar 20, through a hole 45 in a second of the flanges 44, and through a second washer 11 before being secured with the nut 13.

FIG. 4C is a side view of the bracket 40 hinged to the second (upper) end 24 of the rigid bar 20. Note that the bolt or hinge pin 19 enables relative rotational movement of the bracket 40 and rigid bar 20 about the axis of the bolt 19, which relative rotational movement is illustrated by the curved arrows. Furthermore, the hole 25 in the first end 46 of the bracket 40 is shown in an optional configuration as a vertical slot. The vertical slot enables the bracket 40 to engage the second (upper) end 24 of rigid bar 20 over a range of vertical positions of the second (upper) end 24, which range of vertical position is illustrated by the vertical arrows. For example, the bracket 40 may be secured to the ceiling as shown in FIG. 1A, yet the length of the rigid bar 20 may be adjusted upward to assure that the rigid bar 20 is fully supported by the floor 14 and is not hanging from the bracket 40. Still, the bolt or hinge pin 19 prevents the second (upper) end 24 of the rigid bar 20 from moving away from the wall or along the wall (see also FIG. 1A).

Figure 4D:
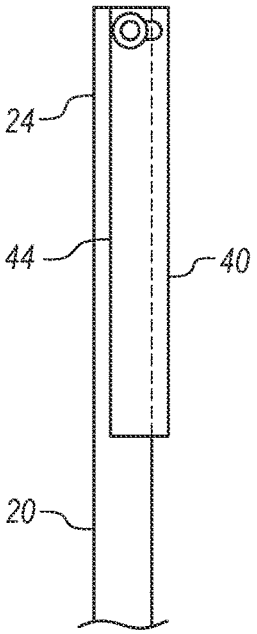

FIG. 4D is a side view of the bracket 40 in retracted position with the two flanges 44 of the bracket 40 receive along opposite sides of the rigid bar 20. This position is preferred to packaging, storage and shipping.

Figure 5A:
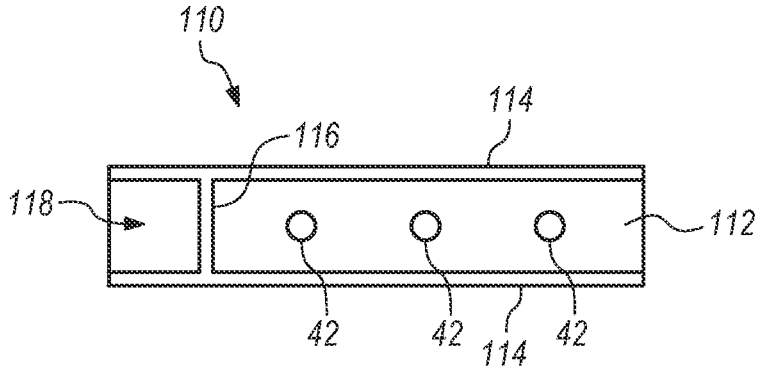
FIGS. 5A-B are bottom and side views of a second bracket and assembly for holding the storage system in an upright position.
Figure 5B:
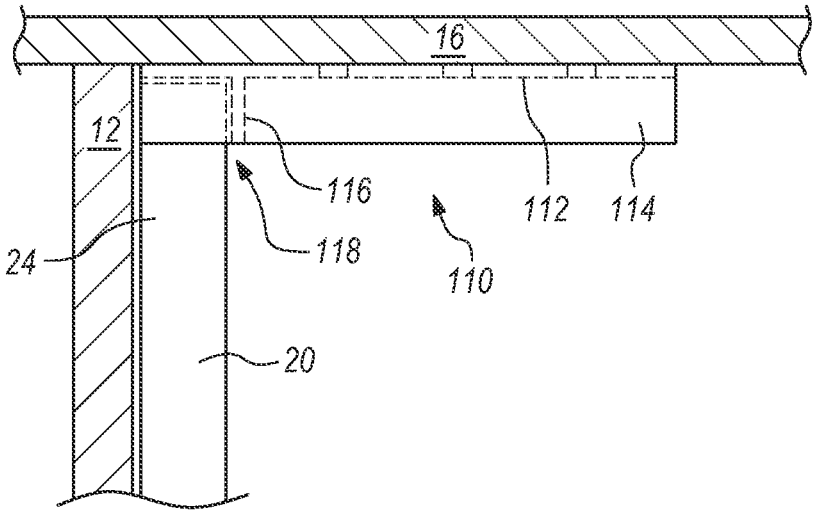

FIGS. 5A-B are bottom and side views of a second bracket 110 for holding the second (upper) end 24 of rigid bar 20 in a selected position along the wall. FIG. 5A is a bottom view of the bracket 110. The bracket 110 has a structure similar to a C-channel, including a flat side 112 for engaging the ceiling and two parallel side flanges 114 that provide the bracket with lateral strength. However, the bracket 110 further includes a stop plate or bar 116 that forms a recess 118 for receiving the second (upper) end 24 of the rigid bar 20. The bracket 110 also includes openings 42, such as three linearly arranged holes for receiving the threaded fasteners 18 therethrough, so that the bracket 110 is firmly secured to the ceiling.

FIG. 5B is a side view of the bracket 110 secured to the ceiling 16 with the recess 118 adjacent or abutting the wall 12. When the second (upper) end 24 of the rigid bar 20 is positioned along the wall 12 and extended into the recess 118, the bracket 110 limits or prevents movement of the second end 24 of the rigid bar 20 in a direction away from the wall 12, as well as to limit or prevent movement of the second end 24 of the rigid bar 20 in a direction along the wall 12. The wall 12 itself will limit or prevent movement of the rigid bar 20 into the wall. As a result, the rigid bar 20 may be kept in a vertical orientation with the second (upper) end 24 directly above the first (lower) end.

Figure 6A:
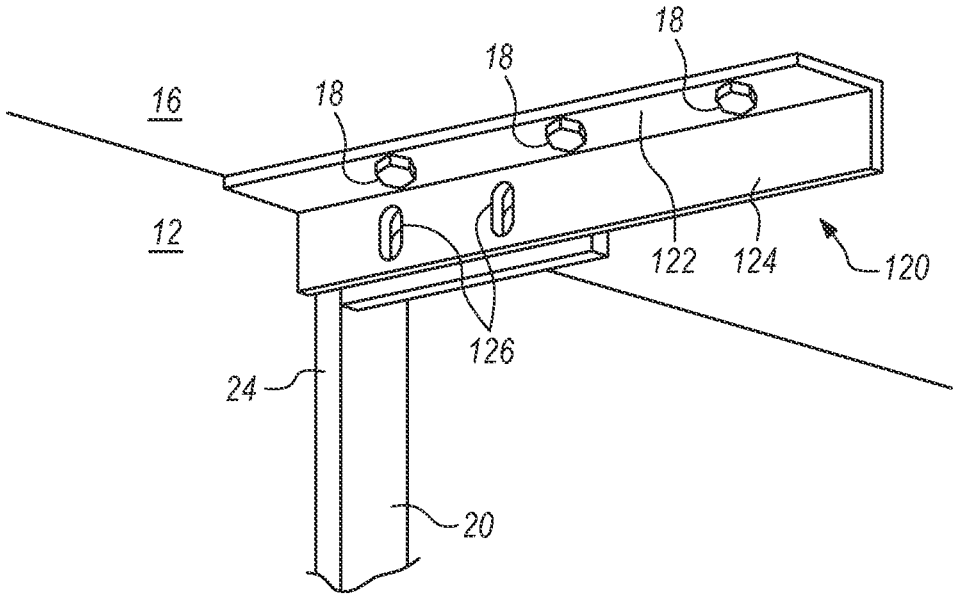
FIGS. 6A-B are left-side and right-side perspective views of a third bracket and assembly for holding the storage system in an upright position.
Figure 6B:
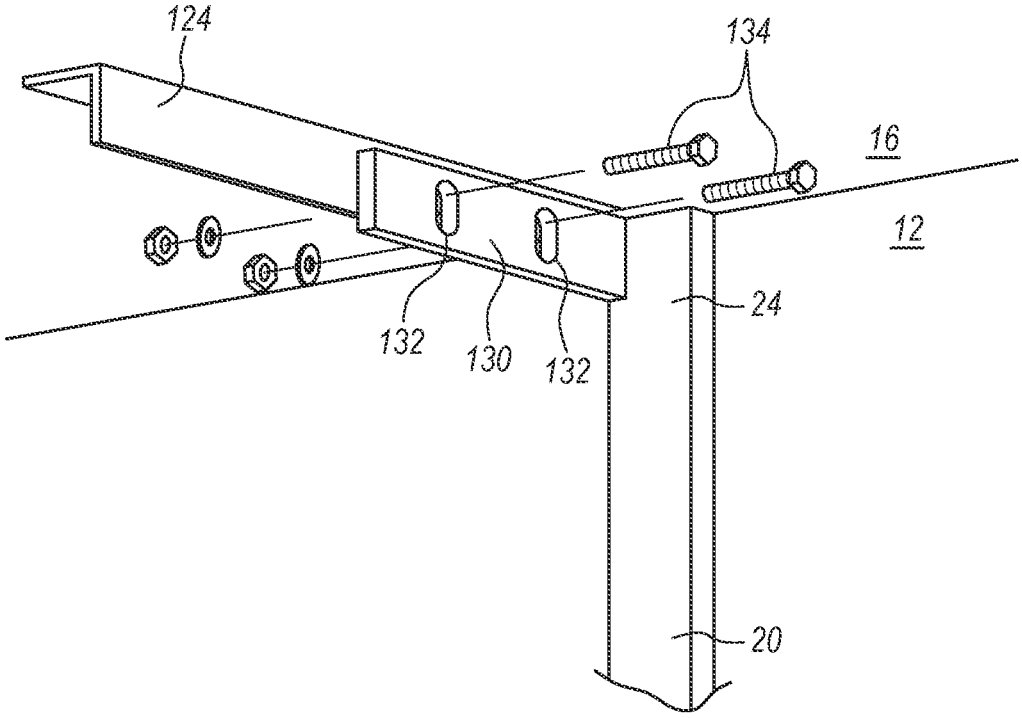

FIGS. 6A-B are left-side and right-side perspective views of a third bracket 120 for holding the rigid bar 20 in an upright position. FIG. 6A shows the third bracket 120 as an L-shaped bracket secured to the ceiling 16. A first side 122 of the bracket 120 includes holes that receive the fasteners 18 as in FIG. 1B. A second side 124 includes openings 126 that are used to secure the second (upper) end 24 of the rigid bar 20 in position.

FIG. 6B shows that the second (upper) end 24 of the rigid bar 20 has an arm 130 extending laterally away from the wall 12. The arm 130 and the second side of the bracket 120 may be positioned in face-to-face contact, and openings 132 in the arm 130 may be aligned with the openings 126 in the second side 124 of the bracket 120. The arm 130 is then secured to the bracket 120 by inserting and securing the fasteners 134, such as bolts. The bolts 134 are preferably not tightened until the rigid bar 20 is already supporting its own weight from the floor. Alternative connections between the bracket 120 and the arm 130 may be used to further assure that the rigid bar 20 and items supported from the rigid bar do not hang from the bracket 120.

Figure 7A:
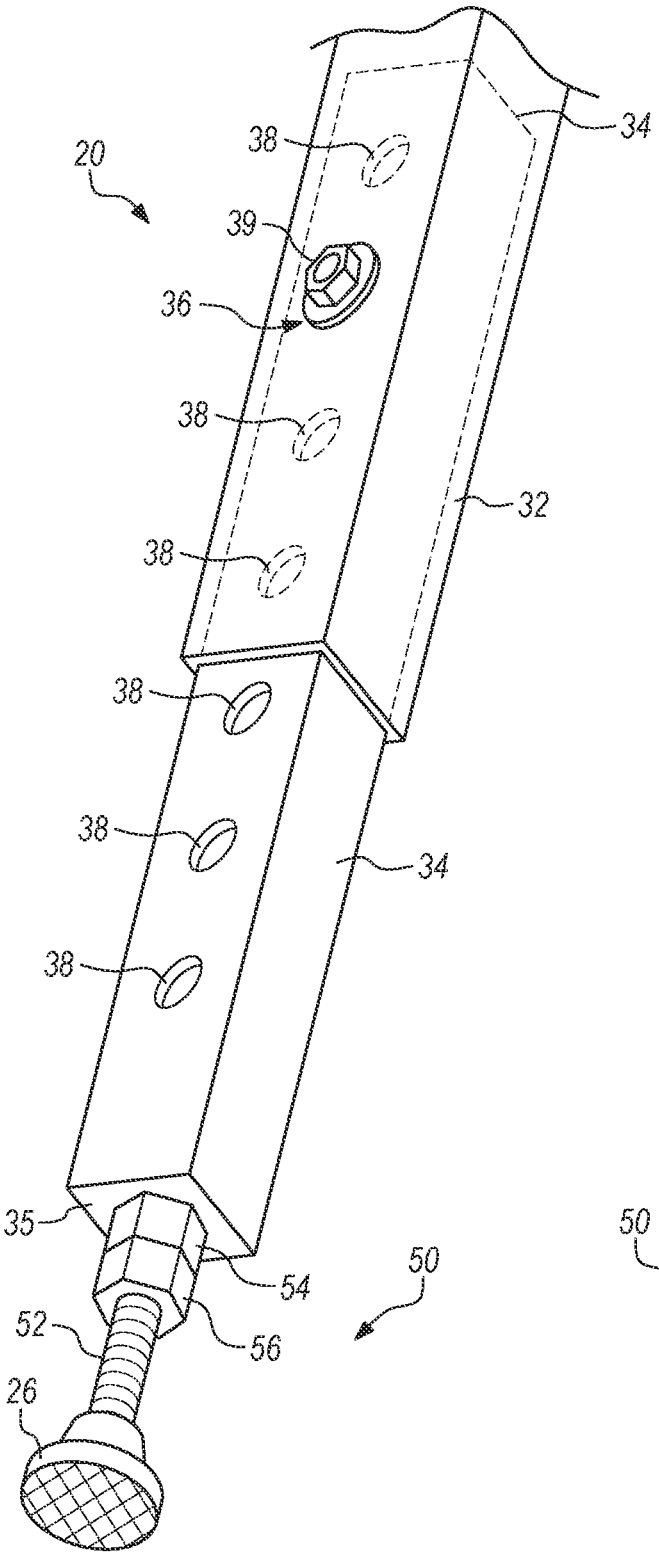
FIGS. 7A-B are perspective and cross-sectional views of an extendable portion of a rigid bar according to one embodiment.
Figure 7B:
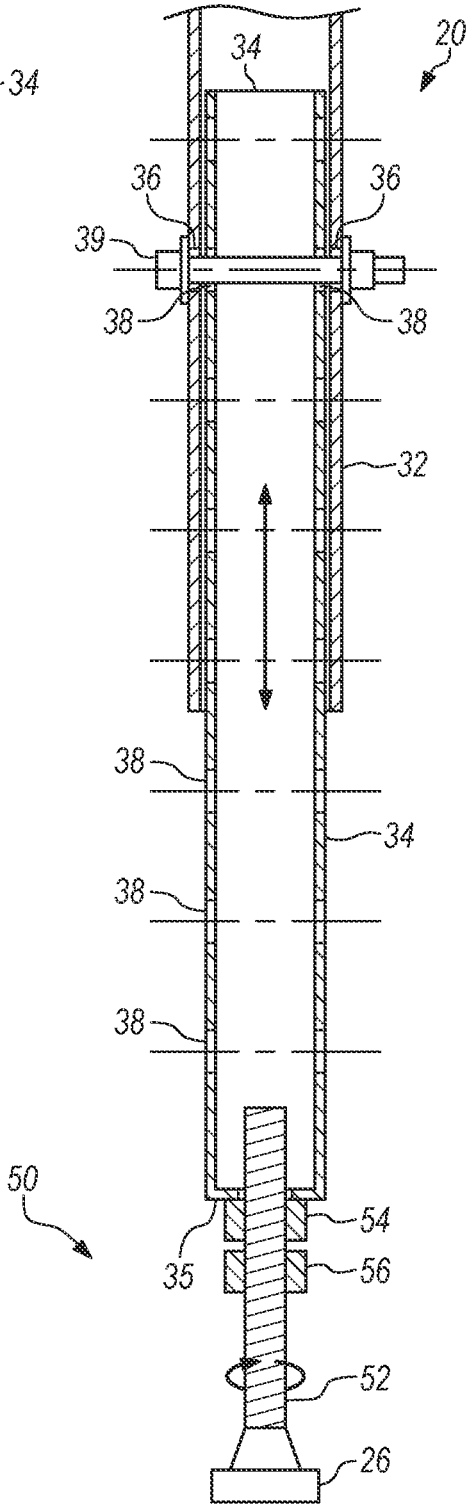

FIGS. 7A-B are perspective and cross-sectional views of an extendable portion of the rigid bar 20 according to one embodiment consistent with FIG. 1A. In reference to both FIG. 7A and FIG. 7B, the rigid bar 20 is telescopically adjustable in length and securable in a plurality of incremental lengths. The first tubular bar section 32 has a hollow internal cavity or channel that slidably receives the second tubular bar section 34. The hole 36 is formed through two opposing sides of the first tubular bar section 32, and a series of holes 38 (8 shown) are formed through two opposing sides of the second tubular bar 34. The series of holes 38 are formed at incremental distances along the length of the second tubular bar section 34. The second tubular bar section 34 may be slidably moved within the first tubular bar section 32 to achieve a total length of the rigid bar 20 that is roughly desired. With one of the holes 38 in the second tubular bar section 34 aligned with the hole 36 in the first tubular bar section 32, a fastener 39, such as a bolt with nut or a secureable pin, may then be inserted through the aligned holes 36, 38 of the first and second tubular bar sections 32, 34. Accordingly, the extent to which the second tubular bar section 34 extends from the first tubular bar section 32 may be selected and secured using the fastener 39.

The rigid bar 20 further includes a threadably adjustable connection 50 that is rotatable to adjust the length of the rigid bar 20. The threadably adjustable connection 50 may be used to adjust the rigid bar 20 to any length between the incremental lengths set by the telescopically adjustable rigid bar sections 32, 34. For example, the threadably adjustable connection may include a threaded shaft 52 connecting the foot 26 to the second rigid bar section 34. Specifically, the threaded nut 54 may be welded over an opening in the end 35 of the second tubular bar section 34. The threaded shaft 52 may be rotated so that the threaded shaft 52 engages the threaded nut 54. Further rotation of the threaded shaft 52 may be performed to extend or retract the threaded shaft 52 relative to the threaded nut 54 so that the foot 26 is positioned to give the rigid bar 20 a desired length. With the rigid bar 20 having the desired length, a second nut 56 may be rotated to engage the first threaded nut 54 and effectively lock the foot 26 in the desired position.

Accordingly, the telescopic adjustment between the two rigid bar sections 32, 34 may provide a "coarse" length adjustment and the threadably adjustable connection 50 may provide a "fine" length adjustment. The combined use of the telescopic and threaded adjustments may be configured to allow the rigid bar 20 to be extended to any exact length (vertical height) over a broad range of lengths that would reach from the floor to a point proximate the ceiling in a residential home or garage.

Figure 8A:
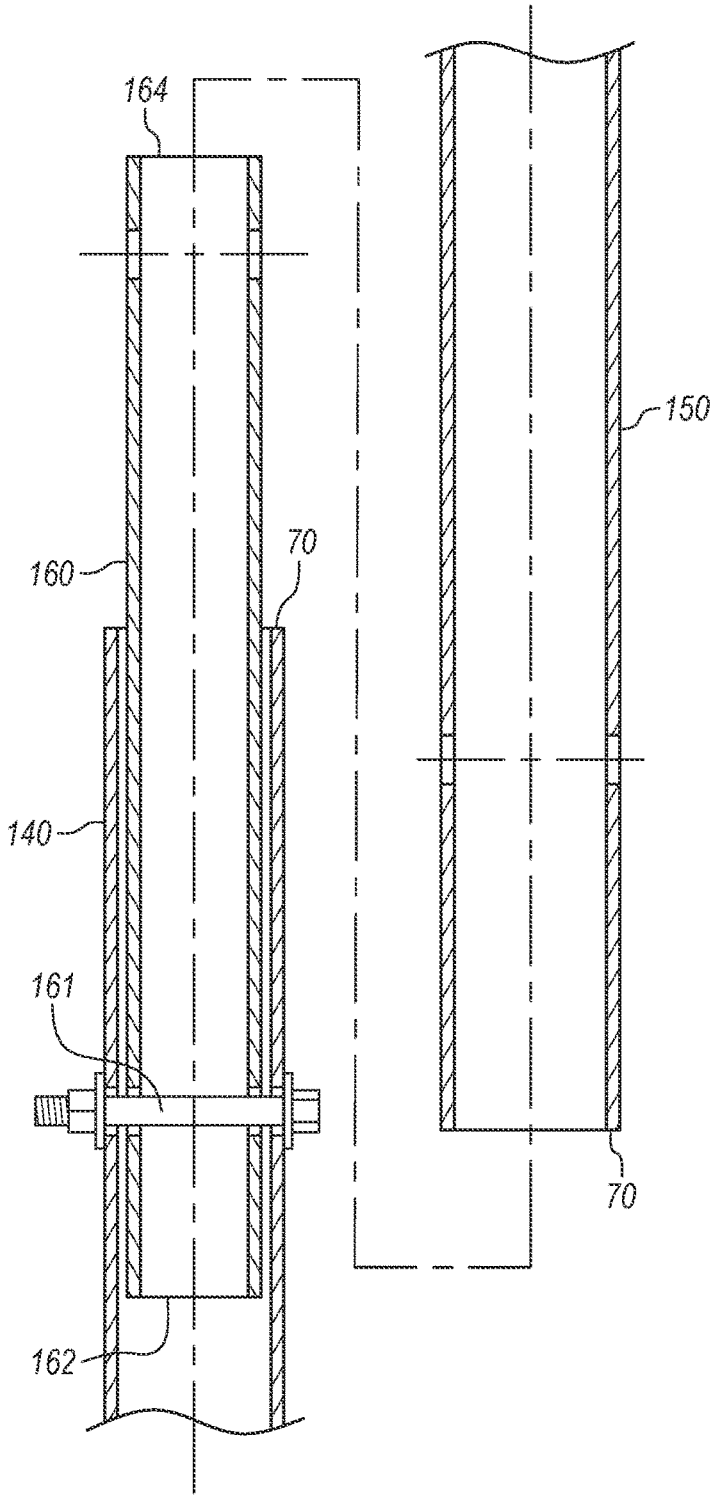
FIGS. 8A-B are cross-sectional views of two separable sections of a rigid bar according to one embodiment.
Figure 8B:
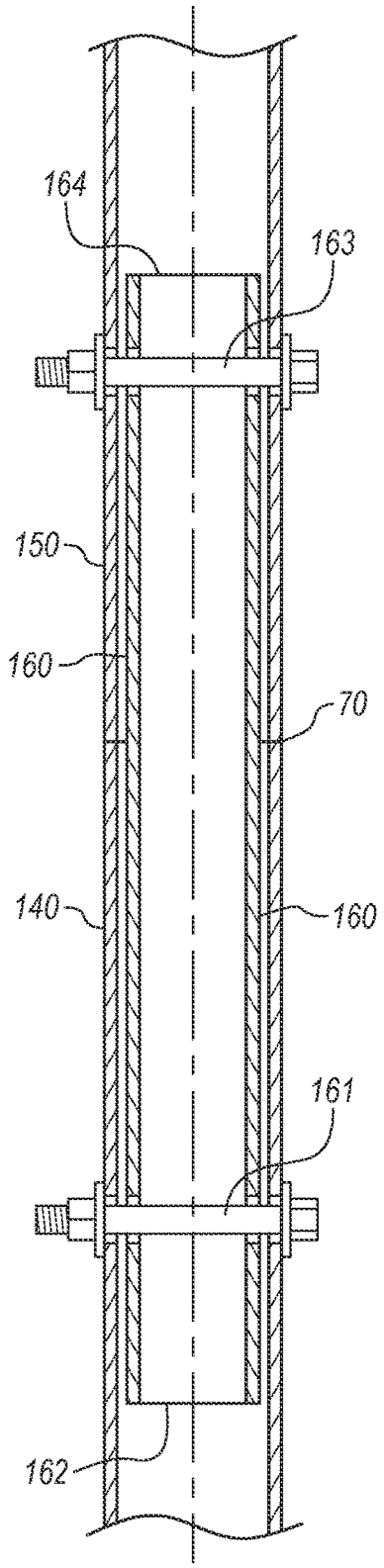

FIGS. 8A-B are cross-sectional views of two separable sections of a rigid bar 20 according to one embodiment. The elongate body 30 of the rigid bar 20 shown in FIG. 1A may be separated into two or more sections at some midpoint 70. As shown here, the rigid bar 20 include first and second separable sections 140, 150. The first section 140 is shown in FIG. 8A as a tubular bar with a hollow channel that already receives and secures a first end 162 of a rigid inner bar 160. A bolt 161 extends through the first section 140 and the first end 162 of the rigid inner bar 160 and is secured with a nut. In FIG. 8A, the rigid inner bar 160 extends out of the first section 140, but the second section 150 is disconnected. In FIG. 8B, the second section 150 has been slid axially over the extended second end 164 of the rigid inner bar 160 until an end of the second section 150 engages an end of the first section 140 at the midpoint or interface 70. The second section 150 is then secured to the second end 164 of the rigid inner bar 160 with a separate bolt 163 and nut. If the rigid inner bar 160 has dimensions that fit closely within the tubular channels of the first and second sections 140, 150, and if the rigid inner bar 160 extends a sufficient distance, such as 6 inches, into both of the first and second sections 140, 150, then the rigid bar 20 should still be very rigid and avoid bowing under a heavy load.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises," "comprising", "includes" and/or "including," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. An apparatus, comprising:

a first rigid bar having a lower end forming a first foot for engaging a floor, an upper end opposite the lower end, and an elongate body having sufficient length to extend vertically along a wall with the first foot engaging the floor and the upper end positioned proximate to a ceiling directly above the floor;

a first bracket that has a first end hinged to the first rigid bar at a point proximate to the upper end of the first rigid bar, wherein the first bracket extends in a lateral direction away from the second end of the first rigid bar to allow the first rigid bar to be positioned against the wall and has a flat portion including a plurality of holes arranged linearly in the lateral direction for receiving fasteners to secure the flat portion of the first bracket against the ceiling, wherein the first end of the first bracket limits movement of the upper end of the first rigid bar in the lateral direction away from the wall;

a first support arm pivotally secured to the first rigid bar for moving the first support arm between a retracted position and an extended position in a direction away from the wall, wherein the first support arm is securable in the extended position using a first angle brace secured to the first rigid bar;

a second rigid bar having a lower end forming a second foot for engaging the floor, an upper end opposite the lower end, and an elongate body having sufficient length to extend vertically along the wall with the second foot engaging the floor and the upper end positioned proximate to the ceiling directly above the floor;

a second bracket that has a first end hinged to the second rigid bar at a point proximate to the upper end of the second rigid bar, wherein the second bracket extends in the lateral direction away from the second end of the rigid bar to allow the rigid bar to be positioned against the wall and has a flat portion including a plurality of holes arranged linearly in the lateral direction for receiving fasteners to secure the flat portion of the second bracket against the ceiling, wherein the first end of the second bracket limits movement of the upper end of the second rigid bar in the lateral direction away from the wall; and a second support arm pivotally secured to the second rigid bar for moving the second shelf support between a retracted position and an extended position in a direction away from the wall, wherein the second shelf support is securable in the extended position using a second angle brace secured to the first rigid bar, and wherein securing the first and second shelf supports in the extended position enables a shelf to be supported by the first and second shelf supports.

2. The apparatus of claim 1, wherein the rigid bar is telescopically adjustable in length and securable in a plurality of incremental lengths, and wherein the rigid bar includes a threadably adjustable member that is rotatable to adjust the length of the rigid bar to any length between the incremental lengths.

3. The apparatus of claim 1, wherein the rigid bar includes two rigid bar sections that are selectively axially securable to form the rigid bar.

4. The apparatus of claim 1, characterized in that the first rigid bar is directed to rest on the floor and support substantially all of the weight of the first rigid bar and any item supported on the first rigid bar, and the first bracket keeps the first rigid bar in a vertical orientation along the wall without any attachment to the wall, and further characterized in that the second rigid bar is directed to rest on the floor and support substantially all of the weight of the second rigid bar and any item supported on the second rigid bar, and the second bracket keeps the second rigid bar in a vertical orientation along the wall without any attachment to the wall.

5. The apparatus of claim 1, wherein the flat portion of the first bracket is positionable against the ceiling to align each of the linearly arranged holes in the first bracket with a first stud or beam extending in the lateral direction within the ceiling such that the fasteners may be driven vertically into the first stud or beam, and wherein the flat portion of the second bracket is positionable against the ceiling to align each of the linearly arranged holes in the second bracket with a second stud or beam extending in the lateral direction within the ceiling such that the fasteners may be driven vertically into the second stud or beam.

* * * * *